US008402725B2

(12) United States Patent
Feijen

(10) Patent No.: US 8,402,725 B2
(45) Date of Patent: Mar. 26, 2013

(54) APPARATUS AND METHOD FOR INSERTING A POSTAL ITEM INTO AN ENVELOPE AND MOISTENING THE FLAP OF THE ENVELOPE

(75) Inventor: Fransiscus Hermannus Feijen, Leeuwarden (NL)

(73) Assignee: Neopost Technologies, Bagneux (FR)

( * ) Notice: Subject to any disclaimer, the term of this patent is extended or adjusted under 35 U.S.C. 154(b) by 265 days.

(21) Appl. No.: 12/469,442

(22) Filed: May 20, 2009

(65) Prior Publication Data

US 2009/0288374 A1 Nov. 26, 2009

(30) Foreign Application Priority Data

May 20, 2008 (EP) ..... 08156564

(51) Int. Cl.
*B67B 7/00* (2006.01)

(52) U.S. Cl. ..... 53/468; 53/284.3; 53/460; 53/467

(58) Field of Classification Search ..... 53/284.3, 53/460, 467, 468, 469, 569; 493/267, 917
See application file for complete search history.

(56) References Cited

U.S. PATENT DOCUMENTS 3,897,720 A * 8/1975 Hiersteiner ..... 493/216
3,936,993 A * 2/1976 Dorer ..... 53/284.3
4,134,322 A * 1/1979 Lillibridge ..... 493/240
4,922,689 A * 5/1990 Haas et al. ..... 53/569
4,944,137 A * 7/1990 Krasuski et al. ..... 53/569
4,955,185 A * 9/1990 Haas et al. ..... 53/460
5,006,194 A * 4/1991 Schmaling ..... 156/442.1
5,095,682 A * 3/1992 Steidinger ..... 53/411
5,097,654 A * 3/1992 Latsounas et al. ..... 53/569
6,554,956 B1 * 4/2003 Dolan et al. ..... 156/441.5
7,104,034 B2 * 9/2006 Stemmle ..... 53/493
7,424,798 B2 * 9/2008 Sytema ..... 53/564
7,788,880 B2 * 9/2010 Kern ..... 53/381.7
8,109,067 B2 * 2/2012 Chatte ..... 53/475
2002/0092276 A1 * 7/2002 Chang et al. ..... 53/494
2003/0121236 A1 * 7/2003 Middelberg et al. ..... 53/460
2003/0141019 A1 * 7/2003 Coret et al. ..... 156/441.5
2004/0172923 A1 * 9/2004 Rawlinson ..... 53/460
2009/0107086 A1 * 4/2009 Keane et al. ..... 53/206
2009/0145082 A1 * 6/2009 Chatte ..... 53/284.3
2009/0282783 A1 * 11/2009 Maaranen ..... 53/411
2010/0089986 A1 * 4/2010 Kline et al. ..... 229/80
2010/0152009 A1 * 6/2010 Edel ..... 493/210

* cited by examiner

*Primary Examiner* — M. Alexandra Elve
*Assistant Examiner* — Eyamindae Jallow
(74) *Attorney, Agent, or Firm* — Sughrue Mion, PLLC

(57) ABSTRACT

In an apparatus for inserting postal items into an envelope, the envelope is brought in an inserting position where the flap of the envelope is held open. A postal item is transported along a postal item transport path towards the inserting position and inserted into the envelope in the inserting position. The envelope with the postal item inserted therein is transported away from the inserting position and closed. A gummed portion of the flap is moistened, wherein the moistening is at least started before the transportation of the envelope away from the inserting position. An apparatus for carrying out such a method is also described.

12 Claims, 6 Drawing Sheets

APPARATUS AND METHOD FOR INSERTING A POSTAL ITEM INTO AN ENVELOPE AND MOISTENING THE FLAP OF THE ENVELOPE

FIELD AND BACKGROUND OF THE INVENTION

The invention relates to an apparatus and a method for inserting a postal item into an envelope.

For the mechanization of the insertion of large numbers of postal items into envelopes, many apparatuses and methods for operating such apparatuses are known. In one type of solution, the envelope is folded around the postal item to be sent. The present invention relates to another type of solution in which the envelopes supplied have an envelope body constituting a pocket or pouch and a flap hinged to the envelope body along a fold for closing off an open throat of the envelope body when the flap is folded against the envelope body. The flaps of the envelopes generally have pre-gummed surface portions. The gum layer on the surface portions can be made to adhere to the envelope body by moistening the gum and pressing the gummed flap against the envelope body.

However, moistening the envelope flaps is a quite delicate process, because the gum must be made sufficiently moist to be made sufficiently adhesive, while on the other hand applying too much liquid (usually water), causes the envelope to wrinkle and excess liquid that is not absorbed by the gum and the envelope may cause the postal items to be damaged. Also the application of the liquid as such needs to be controlled accurately, since spilled liquid may also cause the envelope and/or the contents to become wrinkled and/or stained.

SUMMARY OF THE INVENTION

The invention provides a method for inserting postal items into an envelope, the envelope comprising an envelope body and a flap hinged to the envelope body along a fold, and for closing the envelope, using an inserting apparatus having a postal item transport path, an inserting position downstream of the postal item transport path, an envelope flap moistener and a flap closing member, the method including:

bringing the envelope in the inserting position;

holding the flap of the envelope in the inserting position in an orientation directed away from a closed end of the envelope body;

transporting at least one postal item along the postal item transport path towards the inserting position and inserting the at least one postal item into the envelope in the inserting position;

transporting the envelope with the at least one postal item inserted therein away from the inserting position; and closing the envelope flap;

further comprising moistening a gummed portion of the flap, wherein the moistening is at least started before the transportation of the envelope away from the inserting position.

By at least starting the moistening of the gummed area of the flap before the transportation of the envelope away from the inserting position, the time interval between moistening and closing the flap is relatively long, so that relatively much time is left for the liquid to be absorbed by the gum and for the gum to become dissolved and adhesive. Thereby the amount of non-absorbed water, if any, at the time of closing of the envelope is reduced, so that the risk of damage to the envelope and the contents is reduced.

The invention can also be embodied in an apparatus for inserting documents into envelopes having a flap hinged to an envelope body, including:

a postal item transport path;

a flap holder arranged for holding the flap in an open position while the envelope body is in an inserting position downstream of the postal item transport path for receiving postal items supplied along the postal item transport path in the envelope body; and a moisture applicator for applying moisture to the flap of the envelope;

wherein the flap holder is arranged for contacting the flap locally and leaving areas of the flap adjacent to the flap holder free; and wherein the moisture applicator is arranged for applying moisture to the areas of the flap adjacent to the flap holder.

Such an apparatus is specifically adapted for carrying out a method according to the invention.

Because the moisture applicator is arranged for applying moisture to the areas of the flap adjacent to the flap holder, the moistening can at least be started before the transportation of the envelope away from the inserting position.

Particular elaborations and embodiments of the invention are set forth in the dependent claims.

Further features, effects and details of the invention appear from the detailed description and the drawings.

DETAILED DESCRIPTION

Figure 1:
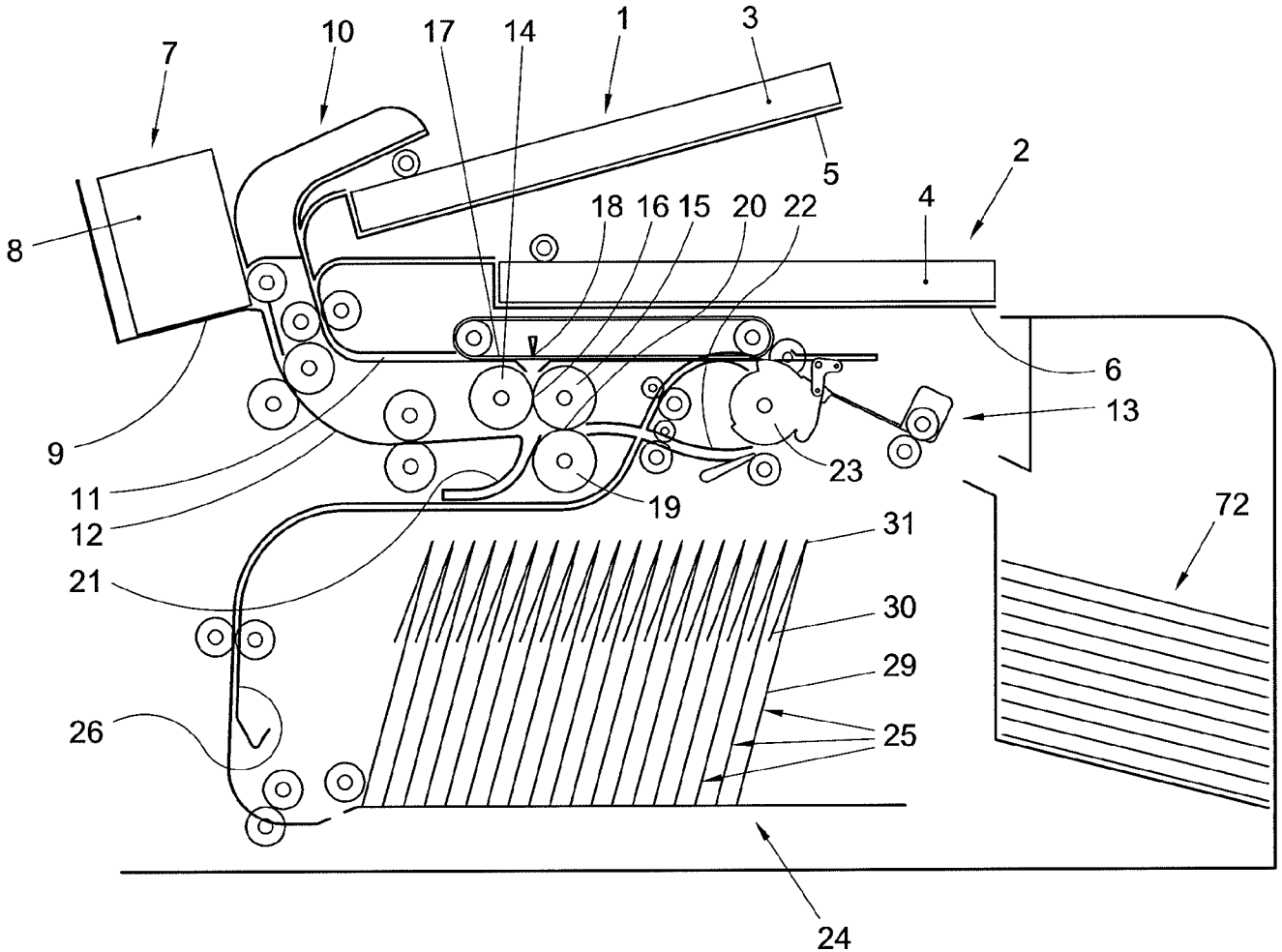
FIG. 1 is a schematic cut-away side view of an example of an apparatus according to the invention.

In FIG. 1, an overview of an example of an inserter apparatus according to the invention is shown. The inserter has sheet feeders 1, 2, for separating and feeding postal items in the form of sheets one by one from stacks 3, 4 in trays 5, 6; a card feeder 7 for separating and feeding postal items in the form of cards from a stack 8 in a hopper 9; and a manual feeder 10 for receiving and feeding individual postal items that are inputted manually, for the individual processing of individual postal items such as letters that have been printed individually and signed personally. A first postal item transport path 11 leads away from the sheet feeders 1, 2 and from the manual feeder 10 and a second postal item transport path 12 is provided for transporting postal items away from the card feeder 7.

The first postal item transport path 11 leads to a pair of folding rollers 14, 15 defining a first folding nip 16 between first and second folding rollers 14, 15 for folding the sheets, a transport belt 17 and a folding knife 18 being arranged upstream of the first folding nip 16 for controlling the folding of the postal items, which may each consist of one or more sheets. Such a folding apparatus is disclosed in more detail in European patent application No. 08152509.

A third folding roller 19 is arranged for defining a second folding nip 20 between the second folding roller 15 and the third folding roller 19. A buckle chute 21 is aligned with the first folding nip 16 for receiving a leading end of a postal item (which may be folded or not) and oriented such that the postal item is then buckled into the second folding nip 20. A postal item transport path 22 extends from the second folding nip 20 towards the inserting position 13 and passes closely along a flap support roller 23.

The inserter is further equipped with a feeder 24 including a hopper for holding stacked envelopes 25 (not all the envelopes are designated by reference numerals) and separating and feeding individual envelopes 25 from the stacked envelopes to an envelope transport path 26. Such a feeder is disclosed in more detail in European patent application No. 07002072.

The envelope transport path 26 extends to a side of the flap support roller 23 which is about diametrically opposite to the side of the flap support roller 23 where the postal item transport path 22 passes along the flap support roller 23.

The envelopes 25 to be processed each have an envelope body 29 constituting a pocket having an opening and a flap 30 hinged to the envelope body 29 along a flap fold 31 (see one of the envelopes 25 in FIG. 1), the flap 30 closing off the pocket when in closed condition. The envelope transport path 26 is bounded by guides and arranged for transporting an envelope 25 with its envelope body 29 in an orientation parallel to the envelope transport path 26 and with the flap fold 30 trailing the envelope body 29 and the flap 30 (see FIG. 2).

The inserter is further equipped with a flap holder 38 having a free flap holder edge 39 and an envelope body guide 40. In a starting position, shown in FIG. 2, the free edge 39 of the flap holder 38 is positioned off-set relative to a continuation of the envelope transport path 26 beyond a downstream end of the envelope transport path 26, such that a leading edge 36 of the envelope 25 travelling in a direction indicated by an arrow 37 passes along a side of the free edge 39 located away from the flap support roller 23. In this example, the downstream end of the envelope transport path 26 is constituted by closing roller nips 48 between a flap closing roller 49 and counter rollers 69 of which the outer circumference projects slightly outside the circumference of the flap support roller 23.

Figure 5:
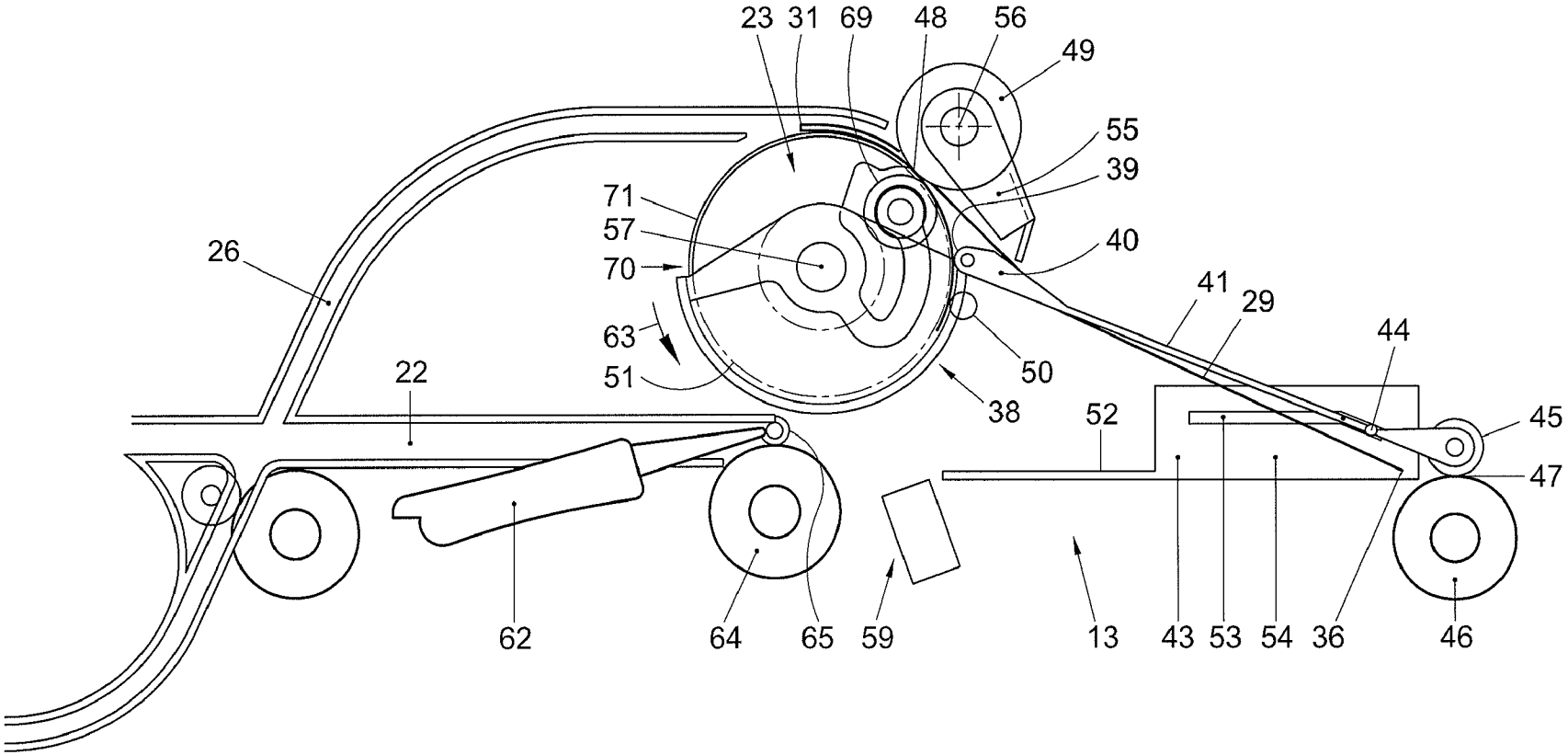

The envelope body guide 40 is integrally formed with envelope body guide control arms 41 of which a free end carries envelope transport rollers 45. Envelope discharge rollers 46 located adjacent to an envelope support platform 52 contact the envelope transport rollers 45 carried by the control arms 41 for forming transport nips 47, at least when the control arms 41 are in a discharge position for discharging the envelope 25 (FIG. 5). The envelope body guide control arms 41 have notches 44 that are guided by guide tracks 53 in guide plates 54 on opposite lateral sides of the envelope support platform 52 and approximately parallel to the envelope support platform 52.

The flap holder 38 is held in the starting position by a flap holder displacement control arm 55 that is pivotable about an axis of rotation 56 coaxial with the flap closing roller 49. A spring force exerted by a spring (not shown) which exerts a moment urging the flap holder 38 in an anti-clockwise sense of rotation (upstream against the sense of transport 37).

Figure 6:
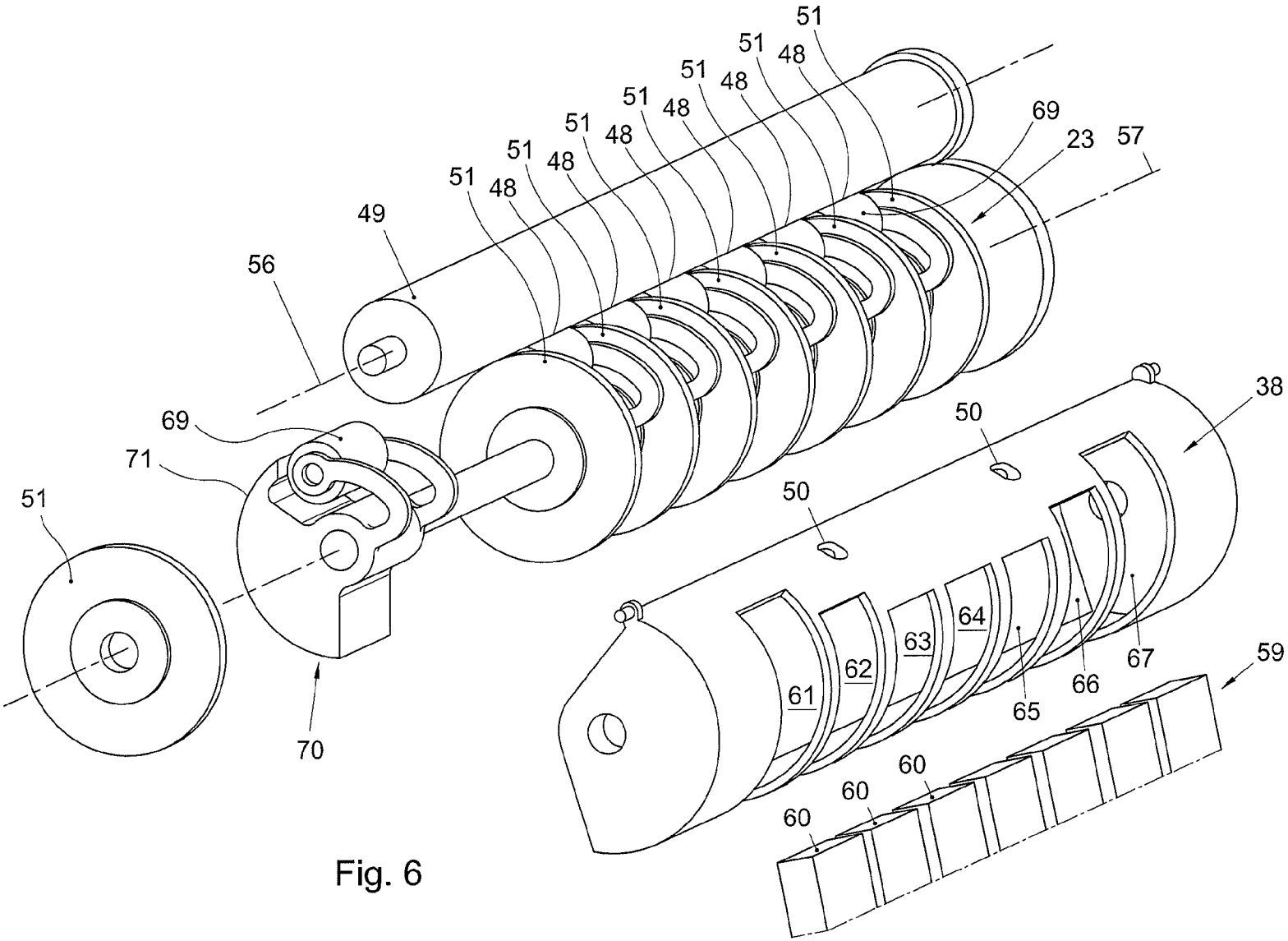
FIG. 6 is an exploded view of some parts shown in FIGS. 2-5.

The flap holder 38 is equipped with rollers 50 rotatably suspended and positioned for holding a flap between the rollers 50 and the flap support roller 23. The flap support roller 23 thus constitutes a member for holding the flap against the flap holder 30. As is best seen in FIG. 6, the flap support roller 23 is constituted by a plurality of disks 51 that are mutually spaced in axial direction and distributed over the width of the flap support roller 23. The rollers 50 of the flap holder 38 are each positioned opposite of one of the disks 51 for forming a flap engagement nip.

In axial direction, the counter rollers 69 are each positioned between two of the disks 51 of the flap support roller 23. The counter rollers 69 are each carried by a counter roller carrier 70, which is rotatably mounted about the axis 57 of the flap support roller 23 and each have a cylinder segment surface 71 having a radius of which the axis 57 of the flap support roller 23 constitutes the center.

Figure 2:
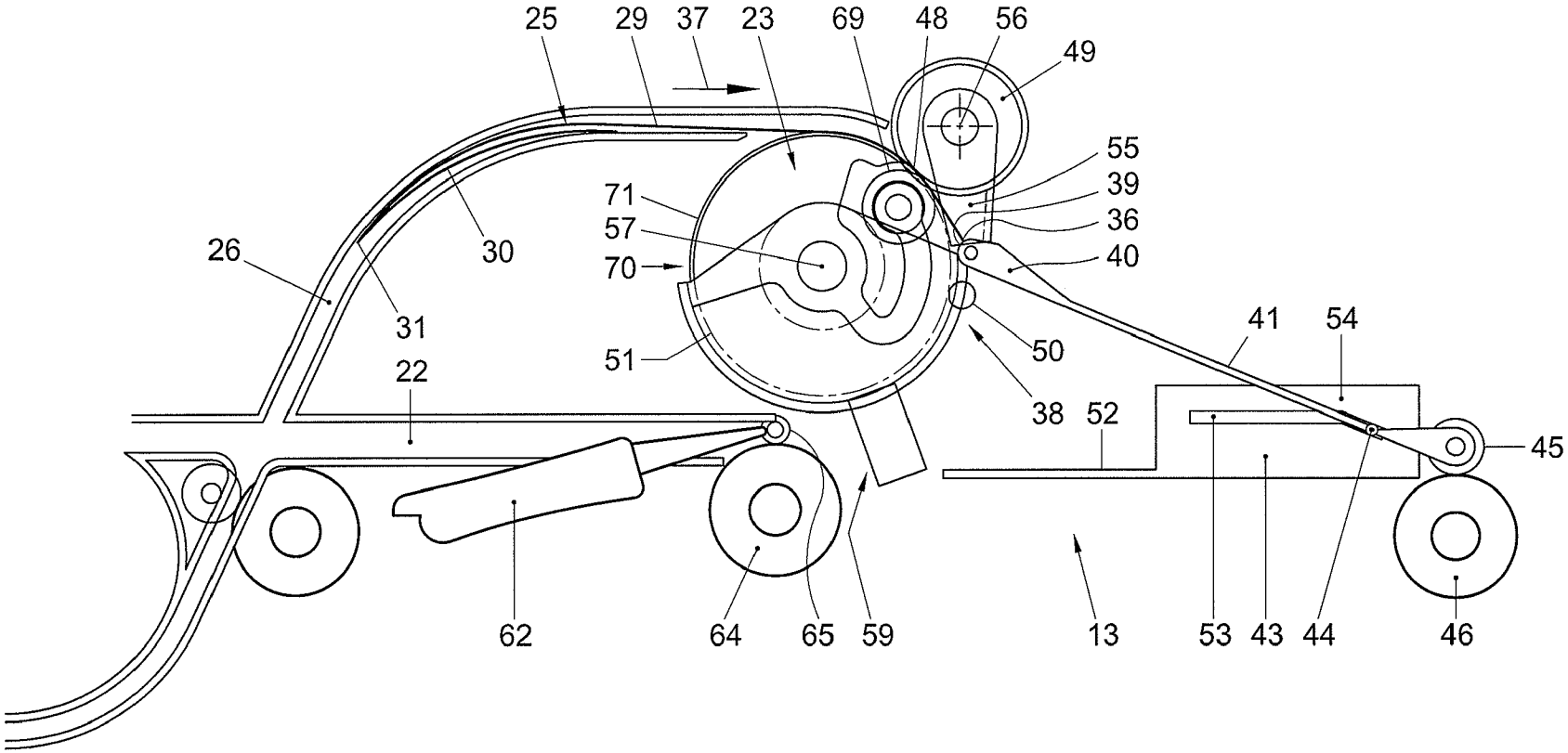
FIGS. 2-5 are schematic side views of a portion of the apparatus according to FIG. 1 in four successive operating stages.
Figure 3:
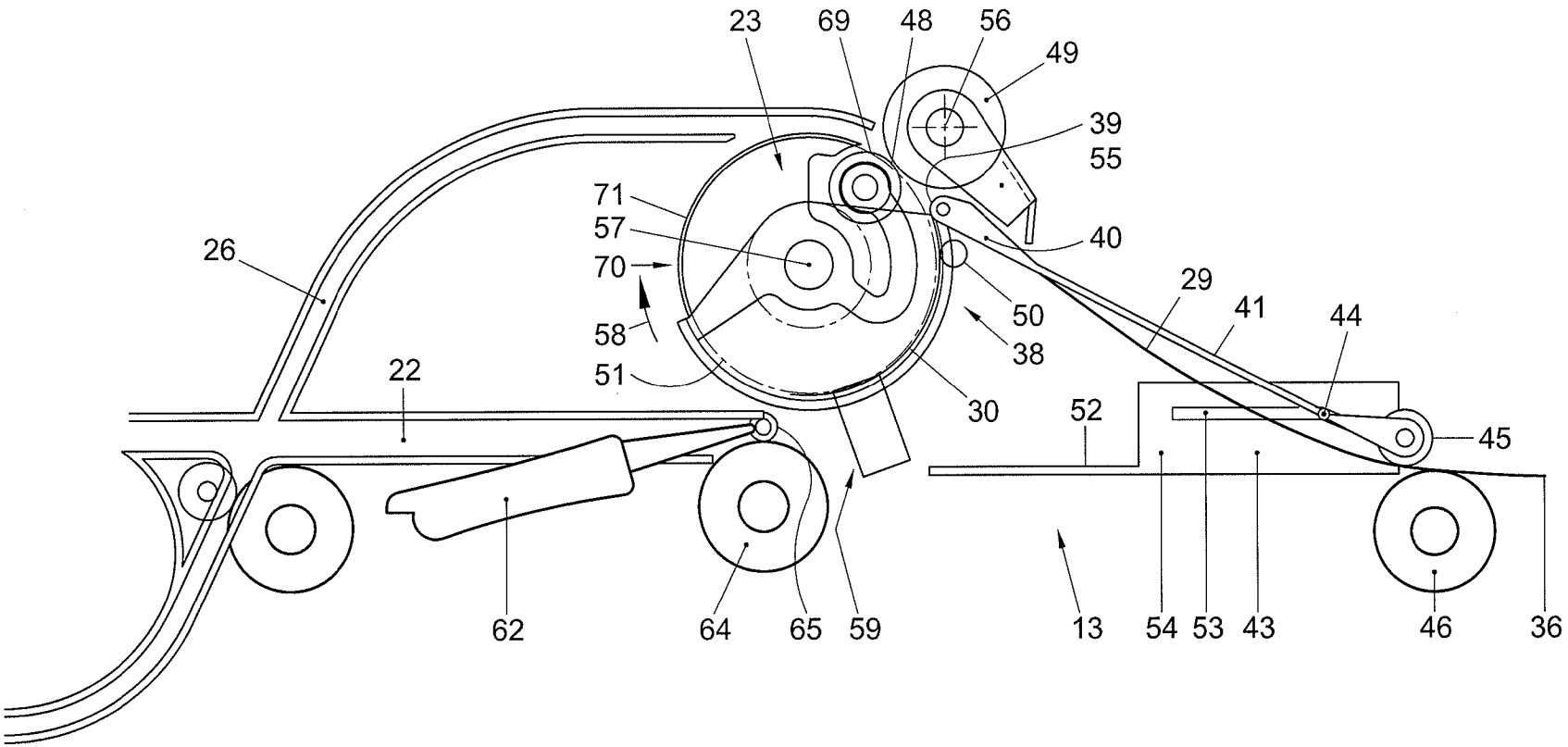

In FIG. 3, the free flap holder edge 39 is in a position off-set to a side of a continuation of the envelope transport path 26 opposite to the side to which the free flap holder edge 39 is off-set in the position shown in FIG. 2, for causing the flap 30 to be peeled away from the envelope body 29 and to enter between the flap holder 38 and the flap support roller 23, as the leading free end of the flap 30 reaches the free flap holder edge 39 and the flap 30 continues to move along with the circumference of the flap support roller 23 while being held in a position closely along the flap support roller 23 by the flap holder 38. Thus, the free flap holder edge 39 is entered between the flap 30 and the envelope body 29 until the flap fold 31 abuts the free flap holder edge 39.

The initial displacement of the free flap holder edge 39 from the starting position shown in FIG. 2 to the flap peeling position shown in FIG. 3 is driven by the spring force urging the flap holder 38 in an anti-clockwise sense of rotation in response to the flap holder displacement control arm 55 being displaced away from the flap support roller 23 and the flap holder 38 by the leading edge 36 of the envelope 25 after the envelope has reached the position shown in FIG. 2. The counter rollers 69 rotate along with the rotation of the flap holder 38 about the axis 57 of the flap support roller 23 in the anti-clockwise sense of rotation, but stay in contact with the flap closing roller 49. With the counter rollers 69 in the operating position shown in FIG. 3, the closing roller nips 48 between the counter rollers 69 and the flap closing roller 49 are displaced about the circumference of the envelope closing roller 49 relative to the operating position shown in FIG. 2, in the same sense of rotation as the sense of rotation 58 of the flap support roller 23 during the passage of the envelope 25 towards the inserting position 13. This causes the leading end of the flap 30 to be fed out of the closing roller nips 48 between the counter rollers 69 and the flap closing roller 49 in a direction more closely along the flap support roller 23 than the direction in which the leading end of the envelope body 29 was fed out of the closing roller nips 48 with the counter rollers 69 in the operating position shown in FIG. 2.

By feeding out the envelope body 29 in a first direction and then feeding out the flap 30 in a second direction different from the first direction, the first and the second directions pointing to different sides of the free flap holder edge 39, the flap 30 is more reliably caught on a side of the free flap holder edge 39 opposite of the side to which the envelope body 29 is guided, so as to be able to reliably bend the flap 30 open.

The inserter is further equipped with an envelope flap moistener 59. The flap moistener 59 is movable between a moistening position in which moistening members 60 of sponge material project towards the circumferential surface of the flap support roller 23 through slots 61-67 (FIG. 6) in the flap holder 38 and a retracted position in which the flap moistener is displaced radially away from the flap support roller 23 and the flap holder 38. The moistener is shown in its moistening position in FIGS. 2 and 3 and in its retracted position in FIGS. 4-6. Surfaces of the moistening members 60 facing the flap support roller 23 are axially located such that the surfaces are not located opposite the circumferential surfaces of the disks 51 of the flap support roller 23. Moistening of the circumferential surfaces of the disks 51 of the flap support roller 23 is thus avoided.

After the envelope flap 30 has entered between the flap support roller and the flap holder 38, the flap 30 contacts the moistener 59 as its leading end reaches the moistener. The flap 30 is then moved along the moistener 59 as it is further inserted between the flap support roller and the flap holder 38, so that the gum is moistened. Since the gum is moistened only in the areas of the flap 30 that are axially in line with the slots 61-67 in the flap holder 38, gum that has been moistened does not contact the flap holder 38 in spite of the flap 30 being moistened prior to insertion of postal items into the envelope 25. That the moistening of the envelope flap 30 is started, and preferably also completed, prior to insertion of postal items into the envelope 25 is advantageous, because more time is left between moistening of the gummed layer of the flap 30 and closing of the envelope 25, thereby allowing the moisture to be absorbed more deeply and evenly by the gum before the envelope is closed. This results in an improved adhesion of the flap 30 to the envelope body 29 and less penetration of humidity into the paper of the envelope body and the contents of the envelope 25.

For obtaining a particularly long period of time between moistening the gum and closing of the envelope, it is advantageous if the moistening is completed during the transportation of the envelope to the inserting position.

The envelope is preferably closed at least a quarter of a second after the flap has been moistened. In increasing order of preference, the time between moistening and closing is preferably at least 0.35, 0.5, 0.75 or 1 s.

An improved absorption of the liquid may also be achieved if the moistening of the flap is started or completed after the postal items have been inserted, but the moistening should preferably at least be started before the transportation of the envelope away from the inserting position, while it is advantageous for leaving the liquid time to absorb and reducing the risk of liquid being shaken off the envelope if the moistening is also completed before the transportation of the envelope away from the inserting position.

If the moistening is started while the envelope flap is stationary, the need of accurate timing of the start of the moistening in relation to detection and movement of the envelope is avoided and the liquid can be applied very accurately in a simple manner, in particular if the moistening is also completed while the envelope flap is stationary.

The flap holder 38 is movable for pivoting the flap 30 held against the flap holder 38 relative to the envelope body 29 about the fold 31 to an open position. In the present example, this is realized in the form of pivotability of the flap holder 38 about an axis of rotation 57 of the flap support roller 23. After the fold 31 between the flap 30 and the envelope body has passed the closing roller nips 48 between the flap closing roller 49 and the counter rollers 69, the flap 30 of the envelope 25 is entrained further by the rotation of the flap support roller 23 in the sense of rotation indicated by arrow 58, since the flap 30 is held against the flap support roller 23 by the rollers 50 of the flap holder 38. When the fold 31 between the flap 30 and the envelope body 29 abuts against the free edge 39 of the flap holder 38, the flap holder 38 is entrained by the envelope 25, of which the flap 30 moves along with the circumferential surfaces of the flap support roller 23, until a position shown in FIG. 4 has been reached in which the free edge 39 of the flap holder 38, and accordingly the fold 31 between the flap 30 and the envelope body 29 is in an accurately controlled position.

The flap holder 38 is coupled to the counter roller carriers 70 for co-rotation with the counter roller carriers 70, so that the rotation of the flap holder 38 also causes the counter roller carriers 70 to rotate in the sense of rotation 58. As the flap holder 38 is rotated, briefly after the counter rollers 69 have become free from the envelope closing roller 49, the cylinder segment surfaces 71 of the counter roller carriers 70 contact the driven flap closing roller 49. The position in which the free flap holder edge 39 is stopped is then controlled by stopping the flap closing roller 49 so that the free flap holder edge 39 reaches the position shown in FIG. 4 in which the envelope 25 is in the insert position with the envelope throat downstream of the postal item transport path 22.

In the present example, this is achieved by providing that when the flap holder 38 reaches the position in which its free edge 39 is positioned for holding the envelope 25 in the insert position, the flap holder 38 contacts an operating member of a wrap spring coupling (not shown) that causes the flap pressing roller 49 to be uncoupled from a drive (not shown).

Figure 4:
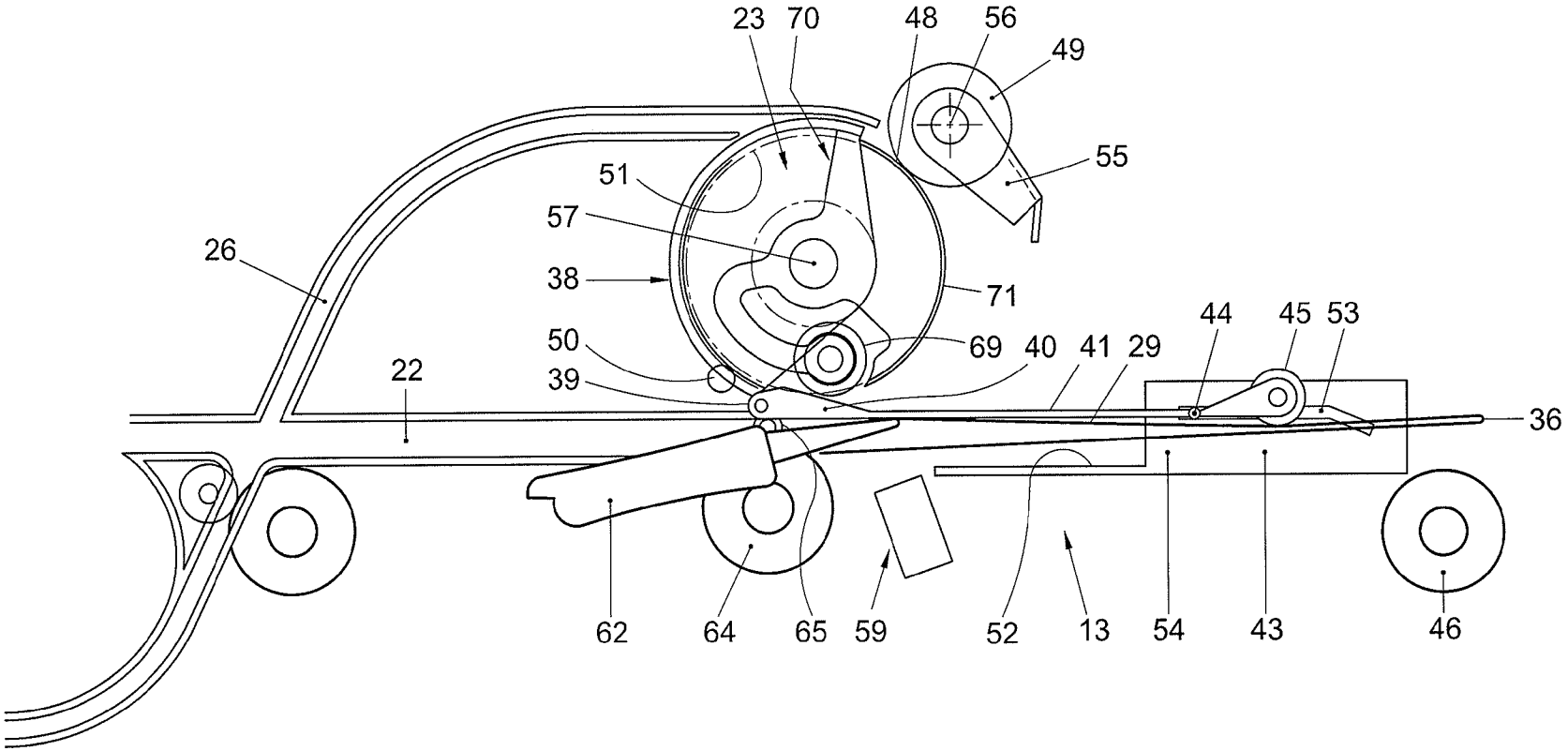

While the flap holder 38 rotates from the flap scraping position shown in FIG. 3 to the insert receiving position shown in FIG. 4, the flap moistener 59 may initially be in its flap moistening position to further moisten the flap 30 of the envelope 25. Depending on the shape and size of the gummed area of the flap 30 and at least before the free edge 39 of the flap holder 38 reaches the flap moistener 59, the flap moistener 59 is retracted to its retracted position so that only or mainly the gummed area of the flap 30 of the envelope 25 is moistened.

In the present example, the flap moistener surfaces 60 are arranged in a row extending along a straight line parallel to the axis 57 of the flap support roller 23. It is, however, also possible to provide that the flap moistener surfaces 60 are arranged in a configuration having sections that extend at angles relative to each other.

After the envelope 25 has reached the inserting position shown in FIG. 4, a throat opener 62 is moved from a retracted position shown in FIGS. 2, 3 and 5 to an inserted position shown in FIG. 4, a free end of the throat opener 62 initially being guided by an upper guide of the postal item transport path 22, then by the envelope body guide 40 and finally along an inner surface of the envelope flap 30 and the envelope body 29. The throat opener 62 in the inserted position holds the throat (the open end) of the envelope 25 open allowing the postal items to be passed into the envelope body 29 smoothly and reliably. During the rotation of the flap holder 38 about the axis 57 of the flap support roller 23, the envelope body guide control arms 41 have been entrained with the flap holder 38, causing the envelope transport rollers 45 to be moved to a position spaced from the envelope discharge rollers 46, leaving room for the envelope body 29 to accommodate to postal items inserted therein.

Next, the separated ones of the postal items 3, 4, 8 fed along the postal item transport path 22 are displaced along the envelope throat opener and into the envelope 25 by insert rollers 64, 65.

After the postal items have been inserted into the envelope 25, the throat opener 62 is retracted to its retracted position and the flap pressing roller 49 is driven in a sense opposite to its sense of rotation during feeding of the envelope 25, causing the counter roller carriers 70 and accordingly also the flap holder 38 and the flap support roller 23, to be entrained in a sense indicated by arrow 63 in FIG. 5, which is opposite to the sense of rotation 58 indicated in FIG. 3. This causes the counter roller carriers 70, and accordingly also the flap holder 38 and the flap support roller 23 to return to the flap opening position shown in FIG. 3 in which position it abuts against the flap holder displacement control arm 55. The flap holder displacement control arm 55 has been left in a position slightly away from the flap support roller 23 to avoid that it interferes with the envelope body 29.

The rotation of the flap support roller 23 causes the flap 30 engaged between disks of the flap support roller 23 and the rollers 50 of the flap holder 38 to be urged back into the closing roller nips 48 between the flap closing roller 49 and the counter rollers 69, which closing roller nips 48 have meanwhile been re-established since the counter roller carriers 70 have returned to the flap opening position. As the envelope 25 is engaged in the closing roller nips 48, the envelope 25 is transported in a discharge sense opposite to the feeding sense along the envelope transport path 26, the flap 30 is closed and pressed against the envelope body 29 between the flap closing roller 49 and the counter rollers 69.

After the entire flap 30 has passed through the closing roller nip 48 between the flap closing roller 49 and the counter rollers 48, the sense of rotation of the flap closing rollers 49 is again reversed and the envelope discharge roller 46 is driven to transport the filled and closed envelope 25 through the nip 47 into an output holder 72.

Finally, the flap holder displacement control arm 55 is pivoted back to the starting position shown in FIG. 2 so that the envelope guide 40 is again repositioned for guiding an envelope body of a next envelope along a top side of the envelope guide 40.

Other variations to the disclosed embodiments can be understood and effected by those skilled in the art in practicing the claimed invention, from a study of the drawings, the disclosure, and the appended claims.

The invention claimed is:

1. A method for inserting postal items into an envelope, the envelope comprising an envelope body constituting a pocket having an opening and a flap hinged to the envelope body along a fold, and for closing the envelope, using an inserting apparatus having a postal item transport path, an inserting position downstream of the postal item transport path, an envelope flap moistener and a flap closing member, the method comprising:

transporting the envelope in a closed position in which the flap closes off the pocket;

opening the envelope by bending the flap open;

bringing the envelope in the inserting position;

holding the flap of the envelope in the inserting position in an orientation directed away from a closed end of the envelope body;

transporting at least one postal item along the postal item transport path towards the inserting position and inserting the at least one postal item into the envelope in the inserting position;

transporting the envelope with the at least one postal item inserted therein away from the inserting position; and the flap closing member closing the envelope flap;

further comprising the envelope flap moistener moistening a gummed portion of the flap, wherein the moistening is started after the flap has been bent open and at least before the insertion of the at least one postal item into the envelope, wherein during insertion of the at least one postal item into the envelope the gummed portion is moist.

2. A method according to claim 1, wherein the moistening is at least started during the transportation of the envelope to the inserting position.

3. A method according to claim 1, wherein the moistening is completed before the transportation of the envelope away from the inserting position.

4. A method according to claim 1, wherein the moistening is completed before the insertion of the at least one postal item into the envelope.

5. A method according to claim 1, wherein the moistening is completed during the transportation of the envelope to the inserting position.

6. A method according to claim 1, wherein the envelope is closed more than a quarter second after the flap has been moistened.

7. A method for inserting postal items into an envelope, the envelope comprising an envelope body constituting a pocket having in opening and a flap hinged to the envelope body along a fold, and for closing the envelope, using an inserting apparatus having a postal item transport path, an inserting position downstream of the postal item transport path, an envelope flap moistener and a flap closing member, the method comprising:

bringing the envelope in the inserting position;

holding the flap of the envelope in the inserting position in an orientation directed away from a closed end of the envelope body;

transporting at least one postal item along the postal item transport path towards the inserting position and inserting the at least one postal item into the envelope in the inserting position;

transporting the envelope with the at least one postal item inserted therein away from the inserting position; and the flap closing member closing the envelope flap;

further comprising the envelope flap moistener moistening a gummed portion of the flap, such that liquid is absorbed by the gum and the gum becomes dissolved and adhesive, wherein the moistening is started before inserting the at least one postal item into the envelope in the inserting position, wherein the at least one postal item is inserted into the envelope while the gum is moist and adhesive, and wherein the envelope is closed by the flap closing member closing the envelope flap while the gum is moist and adhesive such that the flap of the envelope adheres to the envelope body.

8. A method according to claim 7, wherein the moistening is at least started during the transportation of the envelope to the inserting position.

9. A method according to claim 7, wherein the moistening is completed before the transportation of the envelope away from the inserting position.

10. A method according to claim 7, wherein the moistening is completed before the insertion of the at least one postal item into the envelope.

11. A method according to claim 7, wherein the moistening is completed during the transportation of the envelope to the inserting position.

12. A method according to claim 7, wherein the envelope is closed more than a quarter second after the flap has been moistened.

* * * * *